US009508500B2

(12) United States Patent
Reymond et al.

(10) Patent No.: US 9,508,500 B2
(45) Date of Patent: Nov. 29, 2016

(54) CONTACTOR-CIRCUIT BREAKER DEVICE

(71) Applicant: SCHNEIDER ELECTRIC INDUSTRIES SAS, Rueil-Malmaison (FR)

(72) Inventors: Bruno Reymond, Moirans (FR); Maria Vallet, Meylan (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/132,439

(22) Filed: Dec. 18, 2013

(65) Prior Publication Data

US 2014/0175060 A1 Jun. 26, 2014

(30) Foreign Application Priority Data

Dec. 20, 2012 (FR) ..... 12 62442

(51) Int. Cl.
*H01H 9/30* (2006.01)
*H01H 1/20* (2006.01)
*H01H 9/54* (2006.01)

(52) U.S. Cl.
CPC ..... *H01H 9/30* (2013.01); *H01H 1/20* (2013.01); *H01H 9/542* (2013.01); *H01H 9/547* (2013.01)

(58) Field of Classification Search
CPC ..... H01H 1/20; H01H 1/2016; H01H 9/30; H01H 9/542; H01H 3/22; H01H 71/10; H01H 9/547; H01H 9/541; H01H 33/14
USPC ..... 335/6, 35, 167–176; 218/1, 8, 15, 22, 218/34–41, 43, 46, 68, 143
See application file for complete search history.

(56) References Cited

U.S. PATENT DOCUMENTS 3,350,525 A * 10/1967 Gauthier ..... 337/48
4,709,294 A 11/1987 Kim (Continued)

FOREIGN PATENT DOCUMENTS

DE 3137321 A1 4/1983
WO WO 2011/018113 A1 2/2011

OTHER PUBLICATIONS

Machine translation DE3137321(orig. doc. published Sep. 19, 1981).*

(Continued)

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

The invention relates to a contactor-circuit breaker device (2, 102, 202), comprising:

a switch (4) including two pairs of contacts (10, 12) each comprising a stationary contact (14, 16) and a moving contact (18, 20), the stationary contacts (14, 16) being connected in series to an electrical circuit (22), the switch (4) being capable of switching between a closed configuration of the electrical circuit (22) and an open configuration of the electrical circuit (22);

a support member (24) for the moving contacts;

a current cutoff module (6) able to switch the current from the electrical circuit (22) to the cutoff module (6); and a movement apparatus (26) for moving the support member (24) comprising a armature (44) capable of translating the armature such that the support member switches between the closed configuration and the open configuration through a translational and/or rotational movement.

13 Claims, 6 Drawing Sheets

(56) References Cited

U.S. PATENT DOCUMENTS

| | | | | |
|---|---|---|---|---|
| 5,638,038 | A | 6/1997 | Suzuki et al. | |
| 5,841,088 | A * | 11/1998 | Yamaguchi et al. | 218/158 |
| 2011/0162942 | A1* | 7/2011 | Garvin et al. | 200/43.21 |

OTHER PUBLICATIONS

French Preliminary Search Report issued Sep. 9, 2013, in French Application No. 12 62442 filed Dec. 20, 2012 (with English Translation of Categories of Cited Documents), 3 pages.

* cited by examiner

CONTACTOR-CIRCUIT BREAKER DEVICE

The present invention falls within the field of contactor-circuit breaker devices.

More specifically, the invention relates to a contactor-circuit breaker device comprising:

- a mechanical switch including at least two pairs of contacts, each pair of contacts comprising a stationary contact and a moving contact capable of being put in contact with each other, the stationary contacts being connected in series to an electrical circuit, the mechanical switch being capable of switching between a closed configuration of the electrical circuit, in which the stationary and moving contacts of each pair of contacts are in mechanical contact, and an open configuration of the electrical circuit, in which the stationary and moving contacts of at least one pair of contacts are separated from each other;
- a support member for the moving contacts; and
- a current cutoff module comprising a semiconductor device, the cutoff module being connected in parallel to one of the pairs of contacts when the switch is in the open configuration and being able, when the switch is in the open configuration and an electric arc appears in at least one of the pairs of contacts, to switch the current from the electrical circuit to the cutoff module and interrupt the current circulating in the electrical circuit.

In general, a contactor-circuit breaker device is an electrical apparatus used on the one hand to deliberately control the power supply of an electrical circuit, i.e., to perform a contactor function, and on the other hand, to automatically control the cutoff of the current in the electrical circuit, i.e., to perform a circuit breaker function, using a cutoff module, once the cutoff module observes an electrical fault such as a short circuit or an overvoltage in the electrical circuit. A contactor-circuit breaker device is said to be "hybrid" when it comprises both a mechanical switch and one or more semiconductor devices.

Document WO 2011/018113 describes a hybrid circuit breaker device capable of interrupting a fault current in an electrical circuit. It comprises a mechanical switch arranged so as to open the electrical circuit when a fault current appears in the electrical circuit, and a semiconductor current cutoff module in which the fault current is switched. The semiconductor cutoff module is thus arranged to interrupt the fault current. The mechanical switch comprises two stationary contacts connected to the electrical circuit and a rotatable arm comprising two moving contacts, each moving contact being able to be put in contact with one of the stationary contacts. The moving arm is arranged such that, when the switch is open, the distances separating each moving contact and each stationary contact needing to be put in contact are different. The cutoff module is connected in parallel with the stationary contact and the moving contact that has the greatest separating distance when the mechanical switch is open.

However, such a device is not fully satisfactory. Its effectiveness regarding the opening speed of the mechanical switch when a fault current appears in the electrical circuit is in particular insufficient. Furthermore, it is not particularly easy to implement such a device on existing contactors-circuit breakers and to obtain significant sectioning distances without having to oversize the contactor.

A first aim of the invention is to provide a contactor-circuit breaker device capable of allowing rapid opening of a mechanical switch, and consequently rapid switching of the fault current from the electrical circuit to the cutoff module.

Another aim of the invention is to provide a contactor-circuit breaker device making it possible to obtain high sectioning distances, and to do so using existing contactor-circuit breaker devices without increasing the volume and manufacturing costs.

To that end, the invention relates to an apparatus for moving the support member comprising an armature, the movement apparatus being capable of translating the armature such that the support member switches between the closed configuration and the open configuration of the electrical circuit through a translational and/or rotational movement.

The device according to the invention may comprise one or more of the following features, considered alone or according to any technically possible combination:

- the switch is capable of reaching a maximally open configuration and the device includes a stop part capable of stopping the translational and/or rotational movement of the support member when the switch reaches the maximally open configuration;
- the stop part is capable of driving a rotational movement complementary to the translational movement, such that the switch has, in a maximally open configuration, a maximum opening greater than the travel of the movement apparatus;
- the support member is translatable relative to an axis of translation and rotatable relative to an axis of rotation, the axis of rotation being perpendicular to the axis of translation;
- when the switch is in its maximally open configuration, the distance between each stationary contact and each moving contact is different for each pair of contacts, and the cutoff module is connected in parallel to the pair of contacts in which the distance between the moving contact and the stationary contact is smallest;
- the stop part can be put in contact with the moving contact of the pair in which the distance between the moving contact and the stationary contact is smallest when the switch is in its maximally open configuration, the cutoff module being connected to the stop part;
- the cutoff module is connected to the stop part by means of a rigid conductor;
- the moving contacts are situated on either side of the axis of rotation;
- the moving contacts are situated at equal distances from the axis of rotation;
- the device comprises an electrical connecting element, and the moving contacts are situated on the same side of the axis of rotation;
- the stop part is in constant contact with the electrical connecting element;
- the movement apparatus comprises a connecting module capable of connecting the support member to the armature, the connecting module comprising a pivot for tilting the support member and a member for returning the support member toward the armature, the pivot being situated in the axis of translation and the return member being situated separated from the axis of translation;
- the connecting module comprises a stop bearing capable of limiting the rotation of the support member;
- the movement apparatus is an electromagnet; and
- the device comprises a receptacle and a confinement member, the receptacle being capable of receiving the confinement member so as to block the switch exclusively in the maximally open configuration.

The invention will be better understood upon reading the following description, provided solely as an example and done in reference to the appended drawings, in which:

FIG. 1 shows a first embodiment of the contractor-circuit breaker device 2 according to the invention.

Figure 1:
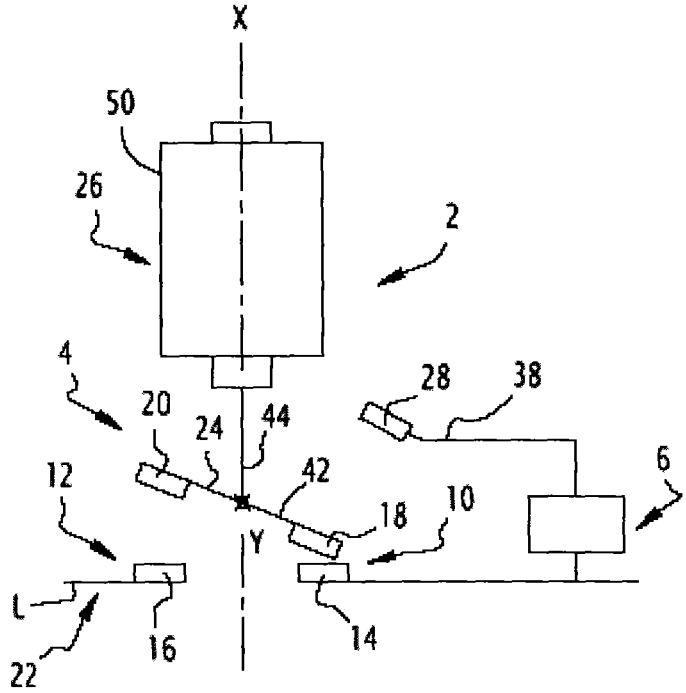
FIG. 1 is a diagrammatic illustration of a first embodiment of the device according to the invention.

The device 2 comprises a mechanical switch 4 and a current cutoff module 6 in particular comprising a semiconductor device 8. The mechanical switch 4 comprises two pairs of contacts 10, 12, each pair of contacts 10, 12 comprising a stationary contact 14, 16 and a moving contact 18, 20.

The contactor-circuit breaker device 2 is capable of establishing or breaking the current circulating in an electrical circuit 22 connected to a charge such as a motor. The electrical circuit 22 is diagrammed in the figures by an electrical line L.

The contactor-circuit breaker device 2 further comprises a support member 24 for the moving contact 18, 20 and a movement apparatus 26 for moving the support member 24. It further comprises a stop part 28.

The stationary contacts 14, 16 of the pairs 10, 12 of contacts are positioned in series in the electrical circuit 22. The moving contacts 18, 20 of the pairs 10, 12 of contacts are mechanically and electrically connected to each other by the support member 24.

Each stationary contact 14, 16 and each moving contact 18, 20 of the same pair 10, 12 of contacts are positioned across from each other, such that they can be placed in mechanical and electrical contact with each other.

According to the invention, the mechanical switch 4 is translatable along an axis of translation X and capable of changing between a closed configuration of the electrical circuit 22 and an open configuration of the electrical circuit 22. In the closed configuration of the electrical circuit 22, the stationary 14, 16 and moving 18, 20 contacts of each pair 10, 12 of contacts are in mechanical contact such the current is capable of circulating between the two pairs 10, 12 of contacts. In the open configuration of the electrical circuit 22, the stationary 14, 16 and moving 18, 20 contacts of at least one pair 10, 12 are separated from each other.

Figure 4:
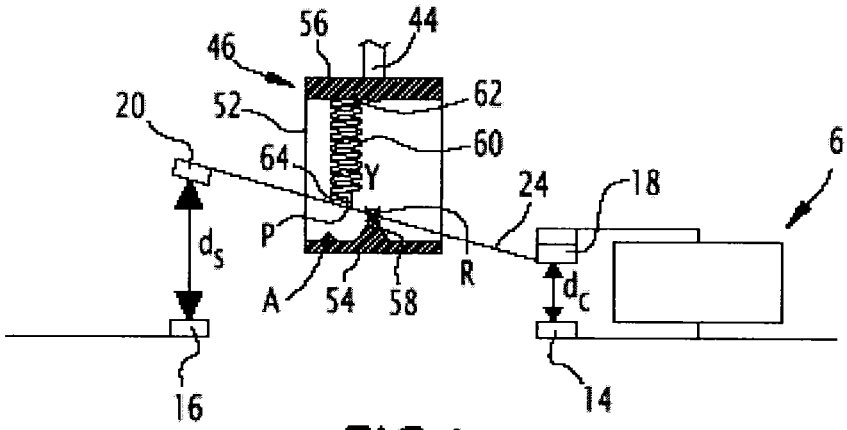
FIG. 4 is a diagrammatic illustration of a detail of the first embodiment of the device according to the invention in the maximally open configuration.

The mechanical switch 4 is further capable of reaching a maximally open configuration. The maximally open configuration is shown in FIGS. 4 and 12 and will be described in more detail hereinafter.

Figure 12:
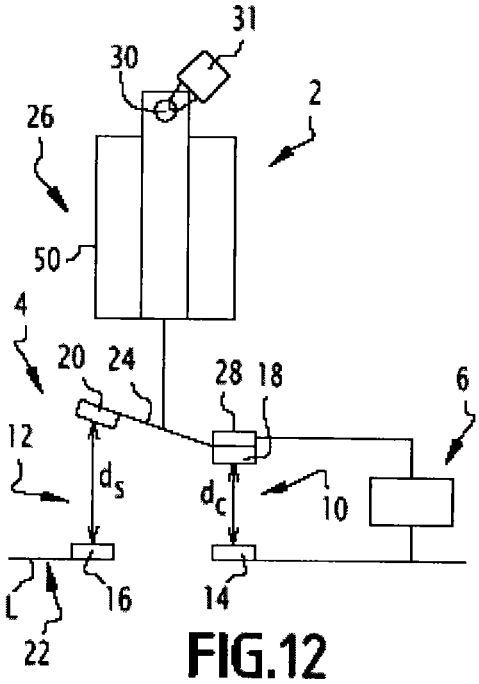
FIG. 12 is a diagrammatic illustration of a sixth operating step of the device according to the invention.

The contactor-circuit breaker device 2 advantageously comprises a receptacle 30 and a confinement member 31, shown in FIG. 12. The receptacle 30 is able to receive the confinement member 31 so as to block the switch 4, exclusively when the switch 4 is in the maximally open configuration.

The confinement member 31 is for example a lock. The lock 31 connects the mechanical switch 4 to a stationary support (not shown) relative to the receptacle 30, allowing the mechanical switch 4 to be kept in its maximally open configuration.

Figure 2:
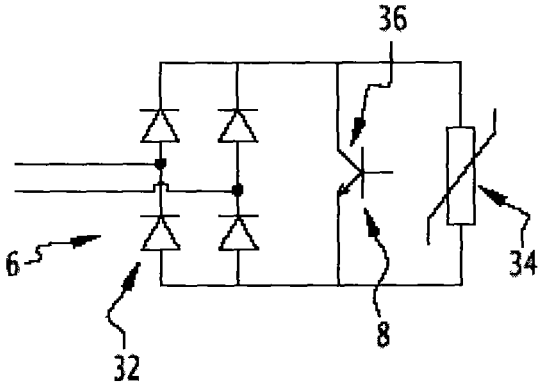
FIG. 2 is a diagrammatic illustration of a cutoff module of the device according to the invention.

In reference to FIG. 2, the current cutoff module 6 comprises the semiconductor device 8, a diode bridge 32, and a varistor 34. Advantageously, the semiconductor device 8, the diode bridge 32, and the varistor 34 are connected in parallel.

The semiconductor device 8 is for example an insulated gate bipolar transistor 36 (IGBT). Alternatively, the semiconductor device 8 is a bipolar transistor, a MOSFET (Metal Oxide Semiconductor Field Effect Transistor), a GTO (Gate TurnOff) thyristor, or an MCT (Metal oxide semiconductor Controlled Thyristor).

In general, the semiconductor device 8 can be locked and primed on command, i.e., it is capable of changing from an on state to a blocked state controllably.

The cutoff module 6 is thus capable of going from an on state, in which the current circulates in the cutoff module 6, to a blocked state, in which no current circulates in the cutoff module 6.

When the switch 4 changes from the closed configuration to the open configuration of the electrical circuit 22, the moving contact 18 and the stop part 28 are in contact, and an electric arc appears between the moving contact 18, 20 and the stationary contact 14, 16 of at least one of the pairs 10, 12, then the cutoff module 6 is able to switch the current coming from the electrical circuit 22 toward the cutoff module 6 and to interrupt the current circulating in the electrical circuit 22.

Advantageously and as shown in FIG. 1, the cutoff module 6 is connected to the stop part 28, by means of a rigid conductor 38.

The support member 24 is formed by an arm 42 on which the moving contacts 18, 20 of each pair 10, 12 are positioned.

The movement apparatus 26 comprises an armature 44. The armature 44 is advantageously connected to the support member 24 for example using a connecting module 46 shown in FIGS. 3 and 4 and that will be described in more detail hereinafter.

The movement apparatus 26 is for example an electromagnet. The electromagnet comprises a stationary body 50 including at least one coil (not shown) and/or at least one permanent magnet, and the armature 44. Hereinafter, the electromagnet for example comprises a single coil.

The armature 44 extends along the axis of translation X and is translatable along the axis of translation X relative to the stationary body 50, under the effect of the magnetic field created by the coil. The armature 44 therefore has a rectilinear trajectory relative to the stationary body 50 of the electromagnet.

The translation of the armature 44 illustrates the translation and/or rotation of the support member 24 of the moving contacts 18, 20. In other words, the armature 44 is capable of translating and/or rotating the support member 24 such that the support member 24 changes between the closed configuration and the open configuration of the electrical circuit 22.

According to the invention, the support member 24 is translatable along the axis of translation X. Thus, the support member 24 goes from the closed configuration to the open configuration for example through a translational movement along the vertical axis X.

As shown for example in FIG. 1, the support member 24 is further preferably rotatable relative to an axis of rotation Y perpendicular to the direction of translation of the support member 24, i.e., perpendicular to the axis of translation X. The support member 24 is thus capable of changing from the closed configuration to the maximally open configuration for example by translating along the vertical axis X and/or rotating relative to the axis of rotation Y.

Figure 3:
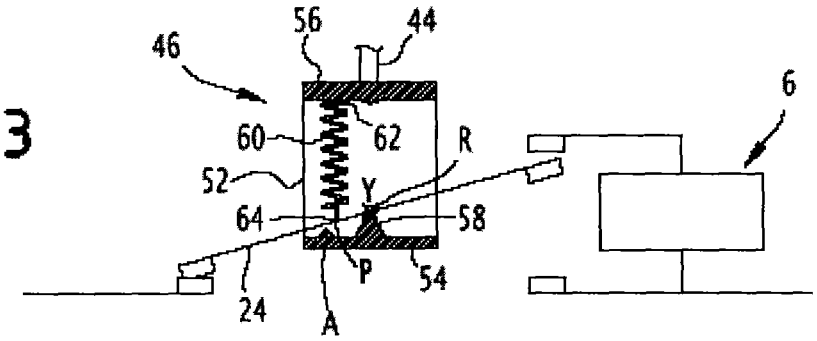
FIG. 3 is a diagrammatic illustration of a detail of the first embodiment of the device according to the invention.

In FIGS. 3 and 4, the connecting module 46 capable of connecting the support member 24 to the movement apparatus 26 is shown in more detail.

The connecting module 46 comprises a side wall 52, a bottom wall 54 and an upper wall 56. The upper wall 56 is opposite the bottom wall 54. The connecting module 46 further comprises a pivot 58 for tilting the support member 24 and a return member 60 for returning the support member 24 toward the armature 44, more specifically toward the upper wall 56, for example a spring.

The connecting module 46 further comprises a stop bearing A capable of limiting the rotation of the support members 24.

The upper wall 56 is fastened to the armature 44 and extends perpendicular to the axis of translation X.

The spring 60 extends parallel to the axis of translation X and has a first end 62 and a second end 64. The first end 62 is connected to the upper wall 56 of the connecting module 46 and the second end 64 is connected to the support member 24 at an anchoring point P of the support member 24.

The pivot 58 advantageously extends parallel to the axis of rotation Y, and for example protrudes from the bottom wall 54 toward the upper wall 56. The pivot 58 comprises a resting edge R that extends in the same way parallel to the axis of rotation Y. The support member 24 rests on the pivot 58, more specifically on the resting edge R of the support member 24.

Preferably, the anchor point P is situated away from the axis of translation X, i.e., the anchoring point P is offset relative to the axis of translation X. Also preferably, the pivot 58 and the resting edge R of the pivot 58 are situated on the axis of translation X.

In FIG. 3, the switch 4 is in the open configuration, and in FIG. 4, the switch is in the maximally open configuration.

As indicated above and as shown in FIGS. 4 and 12, the mechanical switch 4 is capable of reaching the maximally open configuration. In the maximally open configuration, the stationary contact 14 and the moving contact 18 of a first pair 10 among the pairs 10, 12, called cutoff pair 10, are a maximal distance $d_c$, called cutoff distance $d_c$, from each other. The moving contact 18 of the cutoff pair 10 is then in mechanical contact with the stop part 28. The stationary contact 16 and the moving contact 20 of the second pair of contacts 12, called sectioning pair 12, are at a maximum distance $d_s$, called sectioning distance $d_s$, from each other.

The feature according to which the support member 24 is rotatable has the advantage of not having to make the maximal travel of the electromagnet 46 be equal to the sectioning distance, which would be particularly expensive.

According to the invention, the sectioning distance $d_s$ is greater than the cutoff distance $d_c$. In fact, the sectioning distance $d_s$ must be particularly large to allow effective and reliable sectioning of the electrical circuit 22.

The sectioning distance $d_s$ is comprised between 1 mm and 12 mm, preferably comprised between 5 and 9 mm, and in particular equal to 6 mm.

The cutoff distance $d_c$ is comprised between 0.1 mm and 3 mm, and in particular equal to 1 mm.

Furthermore, the distance traveled by the moving contact 18 between the closed configuration and the maximally open configuration is comprised between 0.2 mm and 1.5 mm.

According to the invention, the cutoff module 6 is connected in parallel to the pair 10 of contacts in which the distance between the moving contact 18 and the stationary contact 14 is smallest when the switch 4 is in the maximally open configuration. In other words, the cutoff module 6 is connected in parallel to the cutoff pair 10. Rapid opening of the mechanical switch 4, and consequently rapid switching of the fault current from the electrical circuit 22 to the cutoff module 6, is thus provided.

Advantageously, and as shown for example in FIG. 1, the moving contacts 18, 20 are situated on either side of and at equal distances from the axis of rotation Y.

The stop part 28 is capable of stopping the translational and/or rotational movement of the support member 24 when the switch 4 reaches the maximally open configuration. Preferably, the stop part 28 is positioned across from the moving contact 18 of the cutoff pair 10, on the side of the moving contact 18 opposite the corresponding stationary contact 14 of the same cutoff pair 10.

Thus, the stop part 28 can be put into contact with the moving contact 18 of the pair 10 of contacts in which the distance that separates the moving contact 18 and the stationary contact 14 is smallest when the mechanical switch 4 is in its maximally open configuration.

Figure 5:
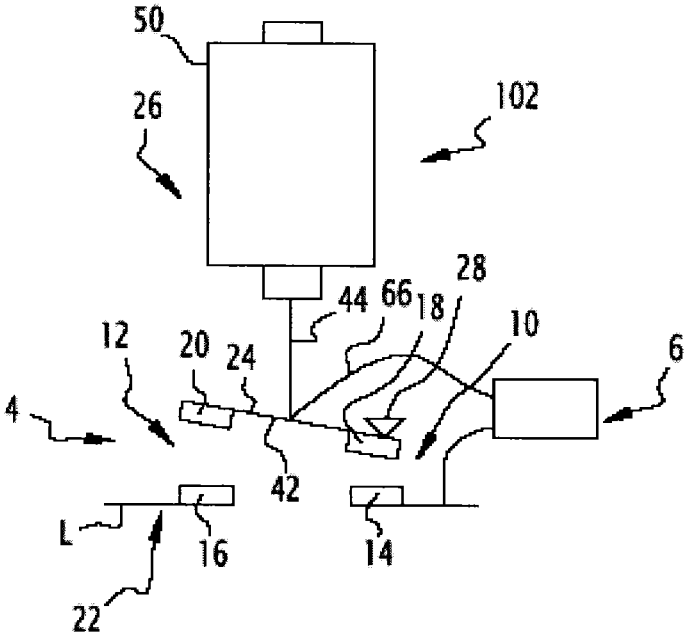
FIG. 5 is a diagrammatic illustration of a second embodiment of the device according to the invention.

A second embodiment of the device 102 according to the invention is shown in FIG. 5.

Unlike the first embodiment of the device 2, the cutoff module 6 is connected to the support member 24, by means of a metal braid 66. The cutoff module 6 is then connected to the support member 24, and therefore to the moving contact 14, 18, continuously, whether the switch is in the closed, open or maximally open configuration.

Figure 6:
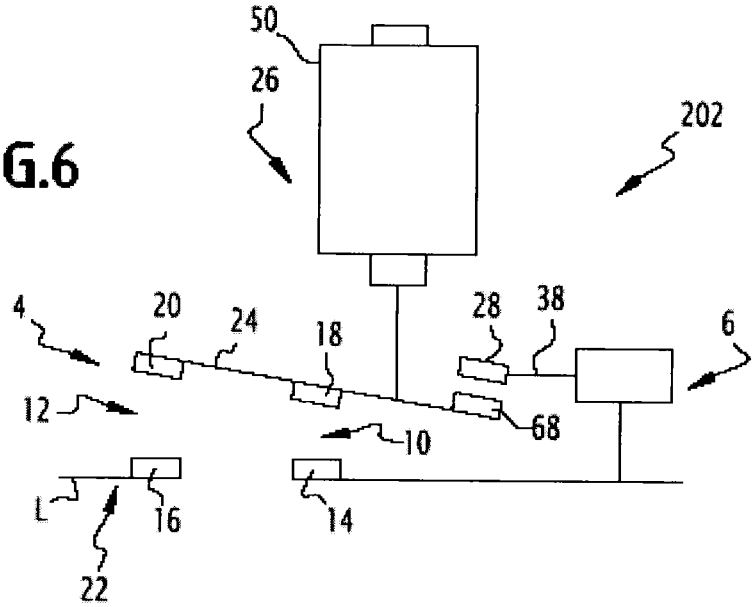
FIG. 6 is a diagrammatic illustration of a third embodiment of the device according to the invention.

A third embodiment of the device 202 according to the invention is shown in FIG. 6.

Unlike the first embodiment of the device 2, the moving contacts are situated on the same side of the axis of rotation Y of the support member 24. Furthermore, the support member 24 comprises an electrical connecting element 68. The electrical connecting element 68 is situated on the side opposite the side of the moving contact 18, 20. The electrical connecting element 68 can be put in contact with the stop part 28.

The operation of the first embodiment of the contactor-circuit breaker device 2 according to the invention will now be described in reference to FIGS. 7 to 15 and in reference to FIG. 16.

Figure 13:
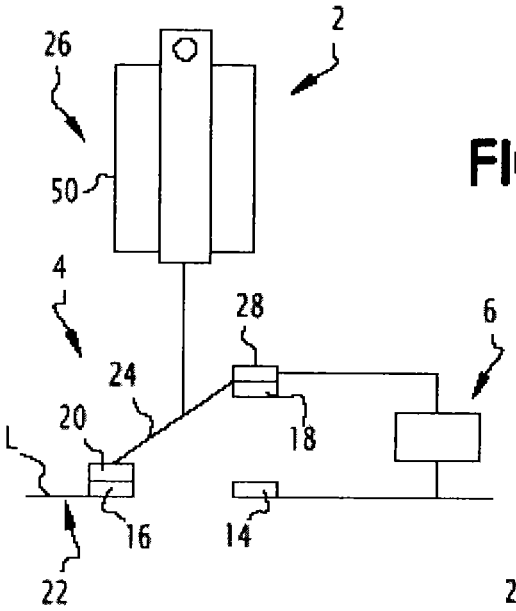
FIG. 13 is a diagrammatic illustration of a seventh operating step of the device according to the invention.
Figure 14:
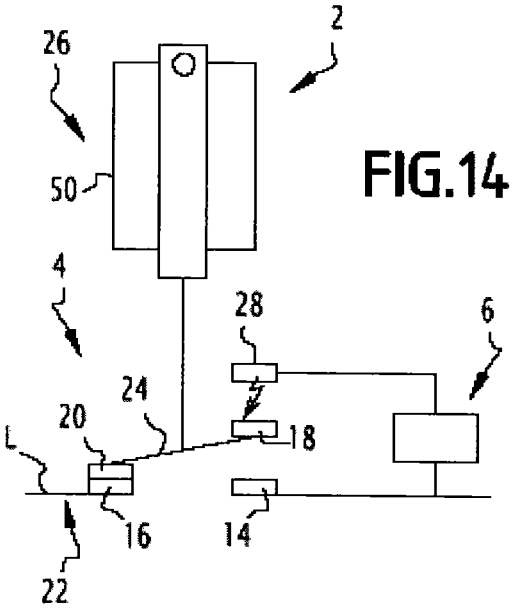
FIG. 14 is a diagrammatic illustration of an eighth operating step of the device according to the invention.
Figure 15:
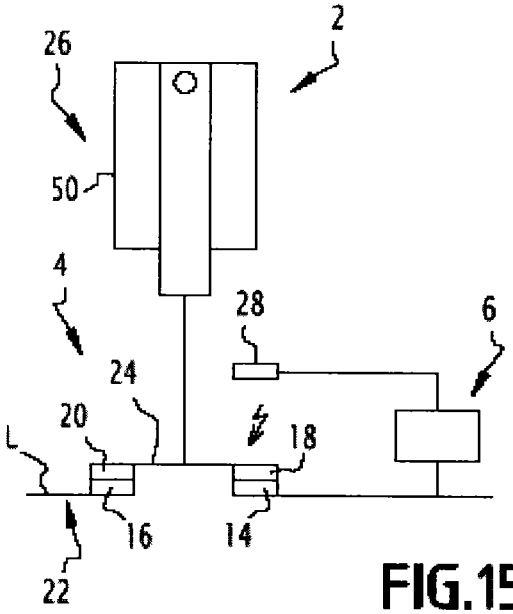
FIG. 15 is a diagrammatic illustration of a ninth operating step of the device according to the invention.

In FIGS. 7 to 12, the successive operating steps of the device 2 according to the invention are shown when it performs its cutout switch function and in FIGS. 13 to 15, the successive operating steps of the device 2 according to the invention are shown when it performs its connector function.

Figure 16:
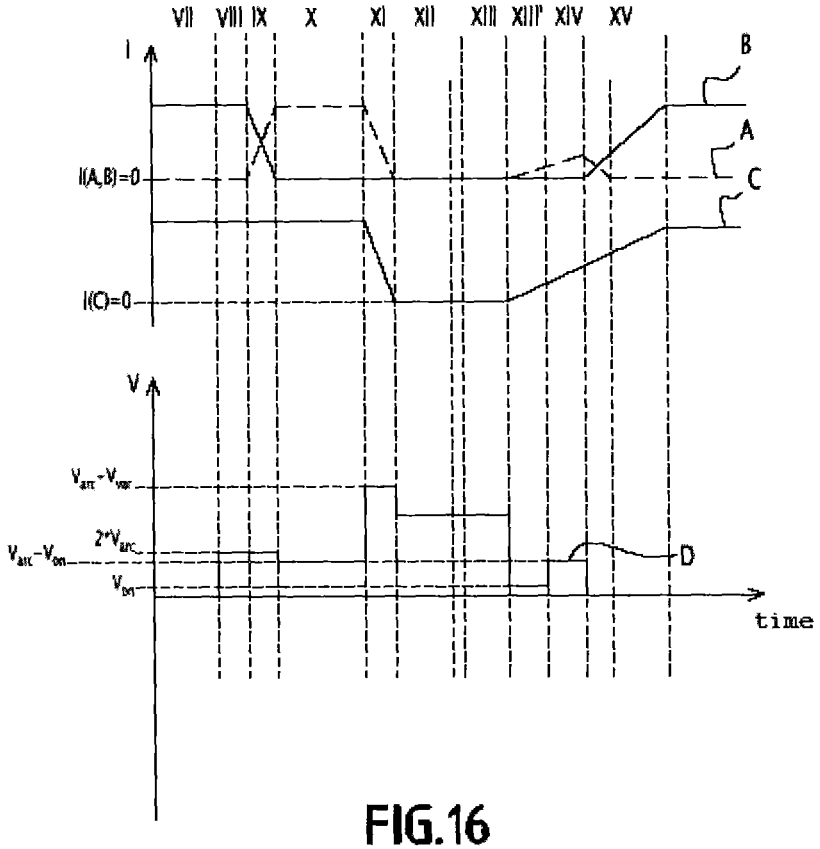
FIG. 16 is an illustration of the evolution of the current in the device and the voltage across the terminals of the device as a function of time during the different operating phases of the device according to the invention.

FIG. 16 shows the evolution of the current in the device 2 and the voltage across the terminals of the device 2 as a function of time. The different states of the device 2 shown in FIGS. 7 to 15 during the operation of the device 2 respectively correspond to parts VII to XV of FIG. 16.

More specifically, curve A depicts the evolution of the current circulating in the cutoff module 6, curve B depicts the evolution of the current passing through the contacts 14, 18 of the cutoff pair 10, curve C depicts the evolution of the current passing through the contacts 16, 20 of the sectioning pair 12, and curve D depicts the evolution of the voltage across the terminals of the device 2.

For better readability of FIG. 16, curves A and B are vertically offset relative to curve C.

Figure 7:
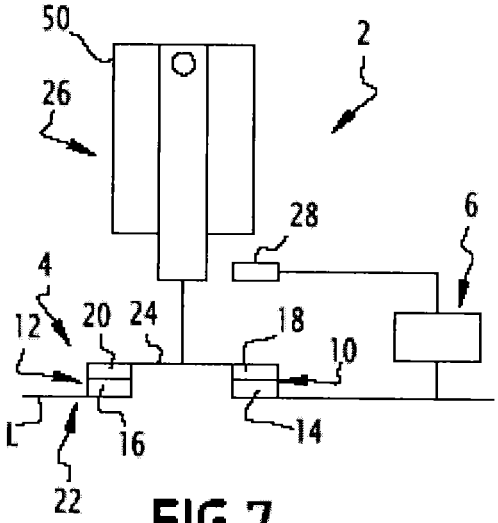
FIG. 7 is a diagrammatic illustration of a first operating step of the device according to the invention.

In the closed position, the mechanical switch 4 is in its metal conduction configuration, i.e., the stationary 14, 16 and moving 18, 20 contacts of each pair 10, 12 are in mechanical contact. This operating phase is shown in FIG. 7. No current circulates in the cutoff module 6, as shown in part VII of FIG. 16. In the closed position, the cutoff module 6 is indifferently in the blocked or on state.

Upon an opening caused by the automatic protection (case of the circuit breaker), following the appearance of a fault current in the electrical circuit 22, or caused by an opening command (case of the contactor), the movement apparatus 26 moves the support member 24.

Figure 8:
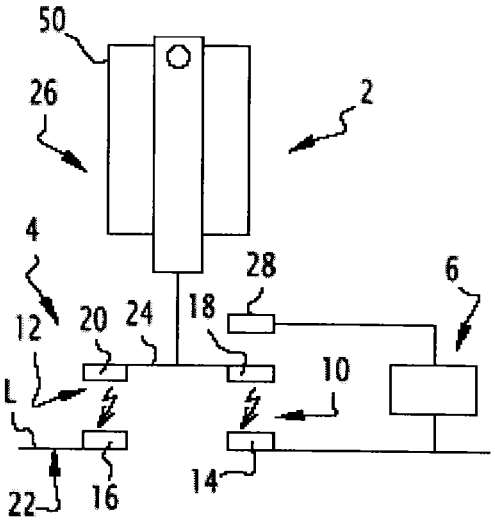
FIG. 8 is a diagrammatic illustration of a second operating step of the device according to the invention.

The support member 24 is moved using the armature 44 such that the mechanical switch 4 goes from the closed configuration to the open configuration in which the moving contacts 18, 20 and the stationary contacts 14, 16 of the pairs 10, 12 of contacts are separated by a non-zero distance. At least one electric arc then appears between at least one of the moving contacts 18, 20 and at least one of the stationary contacts 14, 16 of the pairs 10, 12. This operating phase is shown in FIG. 8.

As shown in part VIII of FIG. 16, an arc voltage $V_{arc}$ then appears between each moving contact 18, 20 and each stationary contact 14, 16 when they are separated. The voltage across the terminals of the device 2 is then equal to $2*V_{arc}$ and corresponds to the electric arcs present in each pair 10, 12 of contacts. The device 2 continues to conduct the current of the electrical circuit 22. As shown in part VIII of FIG. 16, no current circulates in the cutoff module 6, and the module must be primed, in other words commanded to be on, so as to allow the transfer of the current once the moving contact 18 and the stop part 28 are in contact.

Figure 9:
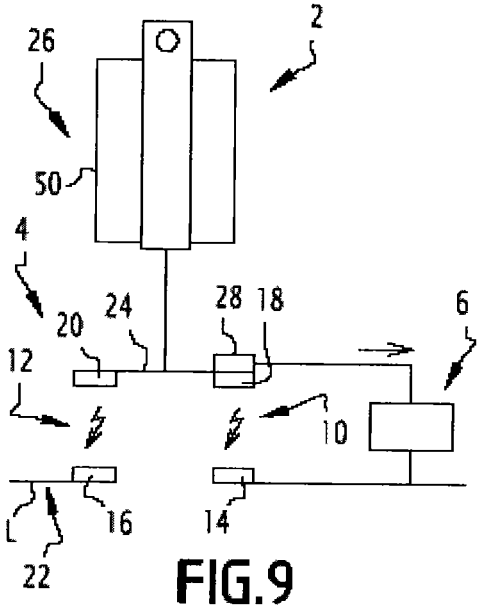
FIG. 9 is a diagrammatic illustration of a third operating step of the device according to the invention.
Figure 10:
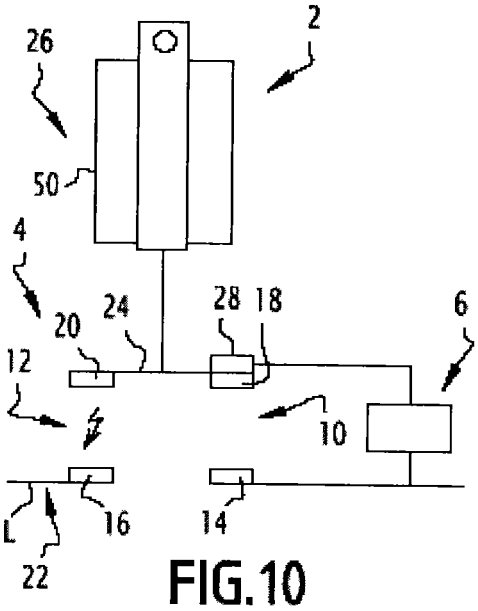
FIG. 10 is a diagrammatic illustration of a fourth operating step of the device according to the invention.

Next, the support member 24 continues its rectilinear travel until the moving contact 18 of the cutoff pair 10 is in contact with the stop part 28. This configuration is shown in FIG. 9, and corresponds to part IX of FIG. 16. At the beginning of this operating phase, the semiconductor device 8 is turned on, such that the current begins to circulate gradually in the cutoff module 6. The semiconductor device 8 is dimensioned to have a voltage $V_{ON}$ below $V_{arc}$. The electric arc situated in the cutoff pair 10 allows the current circulating in the electrical circuit 22 to gradually switch toward the cutoff module 6, the semiconductor device 8 being in an on state allowing the current to circulate in the cutoff module 6. The fault current initially passing in the electrical circuit 22 is gradually switched toward the cutoff module 6 connected in parallel to the cutoff pair 10, by means of the stop part 28. Alternatively, the semiconductor device 8 is turned on as of the operating phase shown in FIG. 8 and part VIII of FIG. 16.

At the end of this operating phase and as shown in part X of FIG. 16, the current is completely switched into the cutoff module 6, and the electric arc of the cutoff pair 10 is extinguished. The voltage across the terminals of the device 2, during this operating phase shown in part X of FIG. 16, is equal to $V_{arc}+V_{ON}$.

Figure 11:
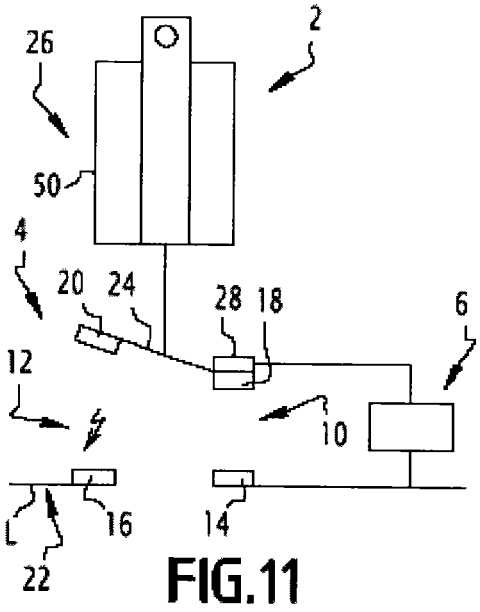
FIG. 11 is a diagrammatic illustration of a fifth operating step of the device according to the invention.

Next, as shown in FIGS. 11 and 12 and in parts XI and XII of FIG. 16, the support member 24 rotates around the axis of rotation Y. The rotation of the support member 24 follows the travel of the armature 44 exceeding the stop side of the contact 18 on the part 28. In fact, the stop part 28 is capable of driving a rotational movement complementary to the translational movement, such that the switch 4 has, in a maximally open configuration, a maximal opening greater than the travel of the movement apparatus 26. Thus, the switch 4 enters the maximally open configuration, i.e., the contacts 16, 20 of the sectioning pair 12 are separated by the sectioning distance $d_s$ for which no current can continue to circulate between the two contacts 16, 20.

At the beginning of the phase XI, the semiconductor device 8 is blocked so as to force the passage of the current in the varistor 34. The varistor 34 has a voltage $V_{var}$ across its terminals. The current in the device 2 decreases rapidly as shown in part XI of FIG. 16, until it becomes zero, as shown in part XII of FIG. 16. During phase XI, the voltage across the terminals of the device is equal to $V_{arc}+V_{var}$. During phase XII, since the current in the circuit 22 is zero, the voltage across the terminals of the device is equal to the supply voltage across the terminals of the charge.

In reference to FIG. 12, the device 2 is in the maximally open configuration providing sectioning. The device 2 is then for example blocked in that maximally open configuration by means of the confinement member 31 received in the receptacle 30. The device 2 is then locked in the open position. This confinement makes it possible to ensure the safety of people downstream from the device during human interventions.

The operation of the device 2 when closed, i.e., the closure of the device 2 during reactivation of the circuit breaker or closure of the contactor, takes place as described hereinafter, in reference to FIGS. 13 to 15 and FIG. 16.

To allow closing of the device 2, it is necessary to remove the confinement member 31. During closing, the device 2 is, in the initial state, in the configuration shown in FIG. 12.

Then, the support member 24 is moved so as to place the contacts 16, 20 of the sectioning pair 12 in contact. This operating phase corresponds to FIG. 13 and part XIII of FIG. 16. The semiconductor device 8 is still in the blocked state, no current therefore circulating in the device 2.

Once only the contacts 16, 20 of the sectioning member 12 are put in contact, the semiconductor device 8 is turned on, such that the current is reestablished in the device 2. This phase corresponds to part XIII' of FIG. 16. The voltage across the terminals of the device 2 is equal to $V_{ON}$. In this way, no electric arc appears between the contacts 16, 20 of the sectioning pair 12.

Next, as shown in FIG. 14, the moving contact 18 moves away from the stop part 28. An arc appears between the stop part 28 and the moving contact 18. The moving contact 18 moves away from the stop part 28 toward the stationary contact 14. The voltage across the terminals of the device 2 is then equal to $V_{ON}+V_{arc}$, as shown in phase XIV in FIG. 16.

Lastly, the moving contact 18 continues its travel until it is alongside the stationary contact 14. Once the moving contact 18 and the stationary contact 14 are alongside one another, and as shown in part XV of FIG. 16, the current begins to decrease in the cutoff module 6. The voltage across the terminals of the device 2 during phase XV, when the current is still non-zero, is zero.

The current circulating in the device 6 decreases until it reaches zero. The current is then completely transferred to a metal conduction.

The device 2 is then in the configuration shown in FIG. 7 and in phase VII of FIG. 16.

The device 2 is closed, and the current circulates in the electrical circuit 22 and no longer circulates in the cutoff module 6.

This operating mode thus makes it possible to preserve the contacts 16, 20 of the sectioning pair 12 from erosion due to electric arcs, and to improve the electrical endurance of the device according to the invention.

The operation of the second embodiment of the device 102 is similar to the operation of the first embodiment of the device 2, with the difference that the cutoff module 6 is continuously connected to the support member 24.

The operation of the third embodiment of the device 202 is similar to the operation of the first embodiment of the device 2, with the difference that in the maximally open configuration, the stop part 28 is in mechanical contact with the electrical connecting element 68. Thus, in the maximally open configuration, the moving contact 18 and the stop part 28 are in electrical contact by means of the support member 24 and the electrical connecting elements 68. The position of the stop part 28 may be optimized so as to minimize the duration of the arc between the contacts 14, 18 of the cutoff pair 10. The stop part 28 and the electrical connecting element 68 are for example in constant contact.

Thus, the contactor-circuit breaker device according to the invention allow it, owing to the translational and/or rotational mobility of the support member 24, to be implemented on contactors-circuit breakers of the state of the art easily. The device according to the invention makes it possible to obtain a fast opening phase, and consequently to obtain fast and effective switching of the current when a fault current appears in the electrical circuit 22.

The invention claimed is:

1. A contactor-circuit breaker device comprising:

a mechanical switch including at least two pairs of contacts, each pair of contacts comprising a stationary contact and a moving contact configured to be in contact with each other, the stationary contacts being connected in series to an electrical circuit, the mechanical switch being configured to switch between a closed configuration of the electrical circuit, in which the stationary and moving contacts of each pair of contacts are in mechanical contact, and an open configuration of the electrical circuit, in which the stationary and moving contacts of at least one pair of contacts are separated from each other;

a support member supporting the moving contacts;

a current cutoff circuit comprising a semiconductor device, the cutoff circuit connected in parallel to one of the pairs of contacts when the mechanical switch is in the open configuration and configured to, in response to the mechanical switch being in the open configuration and an electric arc appearing in at least one of the pairs of contacts, switch the current from the electrical circuit to the cutoff circuit and interrupt the current circulating in the electrical circuit; and a movement apparatus that moves the support member comprising an armature, the movement apparatus translating the armature such that the support member switches between the closed configuration and the open configuration of the electrical circuit through a translational and/or rotational movement, wherein the mechanical switch has a maximally open configuration, and the device includes a stop part that stops the translational and/or rotational movement of the support member when the mechanical switch reaches the maximally open configuration, and wherein the stop part is configured to be put in contact with the moving contact of the pair in which a distance between the moving contact and the stationary contact is smallest when the mechanical switch is in the maximally open configuration, the cutoff circuit being connected to the stop part.

2. The device according to claim 1, wherein the stop part drives a rotational movement complementary to the translational movement, such that the mechanical switch has, in the maximally open configuration, a maximum opening greater than the travel of the movement apparatus.

3. The device according to claim 1, wherein the support member is translatable relative to an axis of translation (X) and rotatable relative to an axis of rotation (Y), the axis of rotation (Y) being perpendicular to the axis of translation (X).

4. The device according to claim 3, wherein the moving contacts are situated on either side of the axis of rotation.

5. The device according to claim 4, wherein the moving contacts are situated at equal distances from the axis of rotation.

6. The device according to claim 3, further comprising:

an electrical connecting element, wherein the moving contacts are situated on the same side of the axis of rotation (Y).

7. The device according to claim 6, wherein the stop part is in constant contact with the electrical connecting element.

8. The device according to claim 3, wherein the movement apparatus comprises a connector that connects the support member to the armature, the connector comprising a pivot tilting the support member and a spring that returns the support member toward the armature, the pivot being situated in the axis of translation (X) and the return member being situated separated from the axis of translation (X).

9. The device according to claim 8, wherein the connector comprises a stop bearing that limits the rotation of the support member.

10. The device according to claim 1, wherein when the mechanical switch is in the maximally open configuration, the distance between each stationary contact and each moving contact is different for each pair of contacts, and the cutoff circuit is connected in parallel to the pair of contacts in which the distance between the moving contact and the stationary contact is smallest.

11. The device according to claim 1, wherein the cutoff circuit is connected to the stop part by a rigid conductor.

12. The device according to claim 1, wherein the movement apparatus is an electromagnet.

13. The device according to claim 1, wherein the device comprises a receptacle and a confinement member, the receptacle receiving the confinement member to block the mechanical switch exclusively in the maximally open configuration.

* * * * *